US005806547A

United States Patent [19]

Derlinga

[11] Patent Number: 5,806,547

[45] Date of Patent: Sep. 15, 1998

[54] COMBINATION UMBRELLA AND GAZEBO

[76] Inventor: Thomas S. Derlinga, 48 Wynding Hills Rd., E. Granby, Conn. 06026

[21] Appl. No.: 854,146

[22] Filed: May 9, 1997

Related U.S. Application Data

[63] Continuation-in-part of Ser. No. 537,638, Oct. 2, 1995, abandoned.

[51] Int. Cl.[6] ..... A45B 25/18

[52] U.S. Cl. ..... 135/33.2; 135/98; 135/117

[58] Field of Search ..... 135/98, 99, 16, 135/20.1, 20.3, 33.2, 33.41, 117, 900, 902

[56] References Cited

U.S. PATENT DOCUMENTS

| | | | |
|---|---|---|---|
| 144,792 | 11/1873 | Prentiss . | |
| 941,458 | 11/1909 | Leach . | |
| 1,774,909 | 9/1930 | Wells . | |
| 1,966,561 | 7/1934 | Ratta, Jr. | 135/4 |
| 2,502,984 | 4/1950 | Parmenter . | |
| 2,546,228 | 3/1951 | Martini . | |
| 2,568,362 | 9/1951 | Primavera . | |
| 2,661,752 | 12/1953 | Kampf et al. . | |
| 2,782,795 | 2/1957 | Small . | |
| 3,621,857 | 11/1971 | May et al. | 135/1 |
| 3,860,022 | 1/1975 | Arndt et al. . | |
| 4,022,233 | 5/1977 | Grundman . | |
| 4,086,931 | 5/1978 | Hall . | |
| 4,202,363 | 5/1980 | Watts et al. . | |
| 4,285,354 | 8/1981 | Beavers | 135/1 |
| 4,422,468 | 12/1983 | Wilson | 135/97 |
| 4,807,655 | 2/1989 | Robertson . | |

FOREIGN PATENT DOCUMENTS

| | | | |
|---|---|---|---|
| 628624 | 12/1994 | European Pat. Off. | 135/20.3 |
| 3521820 | 1/1987 | Germany | 135/20.3 |

*Primary Examiner*—Lanna Mai
*Attorney, Agent, or Firm*—Richard L. Miller, P.E.

[57] ABSTRACT

A combination umbrella and gazebo that can be used as an umbrella or a gazebo. The combination includes a frame, a canopy, and a side. The canopy is affixed to the frame and has an open position and a closed position. The side is affixed to the canopy and has an extended position in which the combination functions as the gazebo and a retracted position in which the combination functions as the umbrella. And, the side achieves its extended and retracted positions by turning a crank which causes a first cord that is operatively connected to eight second cords which are operatively connected to eight third cords which are operatively connected to the side to displace half as much as each of the eight third cords so as to reduce the amount of turning of the crank required to lower and raise the side.

20 Claims, 2 Drawing Sheets

FIG.2
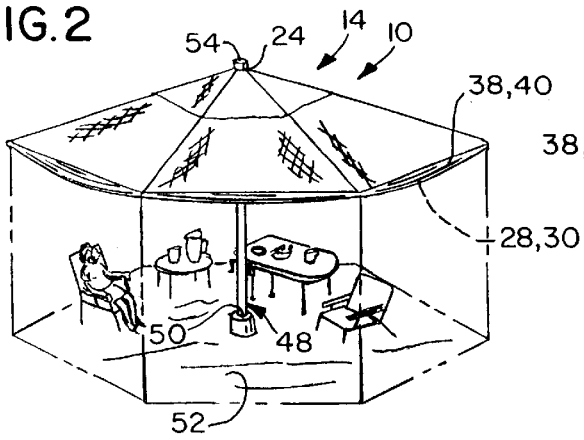
FIG.1
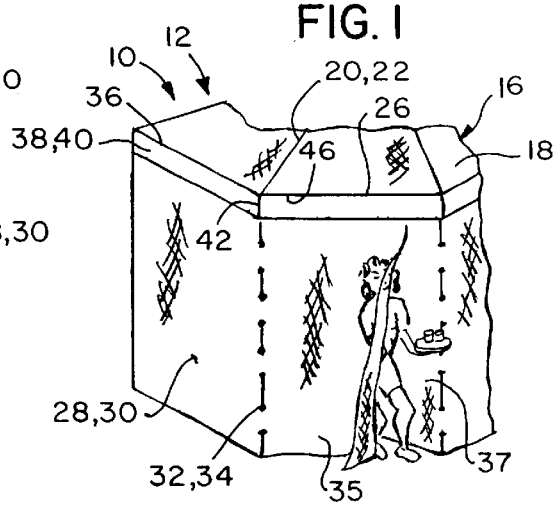
FIG.4
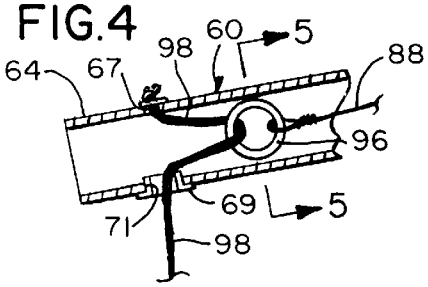
FIG.3
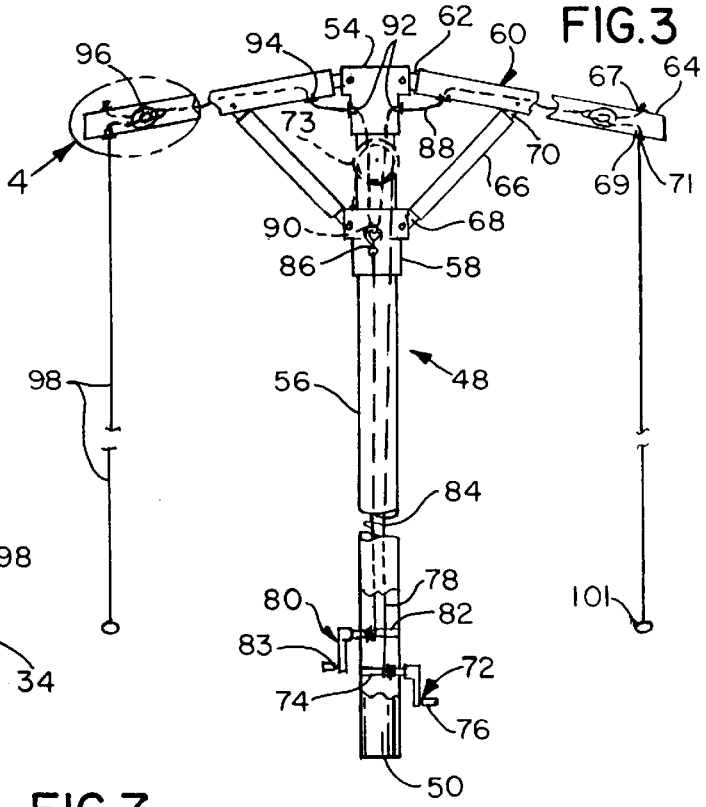
FIG.5
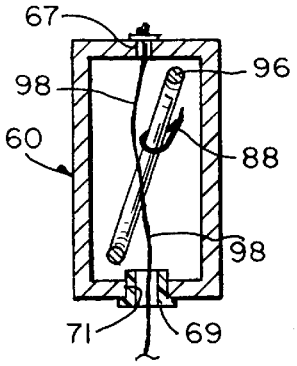
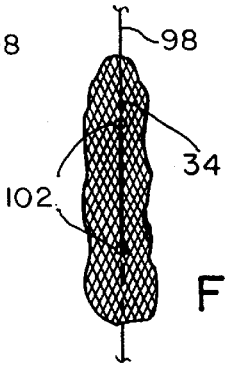
FIG.7

16,18
38,40
34
98
28,30
7
101

16,18
112
110
98
38,40
28,30
106
108
104

16,18
110
104
106
112
108
28,30
38,40

COMBINATION UMBRELLA AND GAZEBO

CROSS REFERENCE TO RELATED APPLICATIONS

The instant application is a continuation-in-part of application Ser. No. 08/537,638, filed Oct. 2, 1995, now abandoned for COMBINATION FOLDABLE GAZEBO AND UMBRELLA, and to be expressly abandoned when the instant application is afforded a filing date.

BACKGROUND OF THE INVENTION

1. Field of the Invention

The present invention relates to an umbrella. More particularly, the present invention relates to a combination umbrella and gazebo.

2. Description of the Prior Art

Numerous innovations for enclosures have been provided in the prior art that will be described. Even though these innovations may be suitable for the specific individual purposes to which they address, however, they differ from the present invention.

FOR EXAMPLE, U.S. Pat. No. 144,792 to Prentiss teaches a portable mosquito and fly net for the purpose of preventing mosquitoes and other insects from annoying people who reside in neighborhoods infected with such insects. The invention also serves as a sun-shade, so as to protect people from the direct rays of the sun. The invention consists in an umbrella, sun-shade, or similar article covered with suitable gauze or netting. To the lower edge of the sun-shade of the umbrella is secured a similar netting of ample dimensions, so that one or more persons can be protected under it. The height of the netting may be made so that the lower edge thereof shall reach the ground when the person who carries it is standing.

ANOTHER EXAMPLE, U.S. Pat. No. 941,458 to Leach teaches tents and more particularly to a class of portable tents adapted to be carried by hand and capable of being quickly raised and taken down.

STILL ANOTHER EXAMPLE, U.S. Pat. No. 1,774,909 to Wells teaches improvements in the class of umbrellas known as "beach" umbrellas, in which an umbrella of relatively large size is furnished with a stem extension adapted for driving or pushing into the ground so that the umbrella stands up without further external support and forms a convenient shade in hot weather.

YET ANOTHER EXAMPLE, U.S. Pat. No. 2,502,984 to Parmenter teaches an umbrella construction which will give the user additional protection against rain or snow as compared with umbrellas of the type generally used hitherto, and also to provide means for varying at will the degree of such additional protection.

STILL YET ANOTHER EXAMPLE, U.S. Pat. No. 2,546,228 to Martini teaches an umbrella shield adapted to be suspended from the umbrella when it is raised and which is preferably made of transparent material so that a full view may be had by the user of the umbrella and at the same time the shield will extend sufficiently down over the body of the user of the umbrella to protect him or her from becoming splashed with rain entering beneath the sides of the umbrella as when there is wind as well as rain.

YET STILL ANOTHER EXAMPLE, U.S. Pat. No. 2,568,362 to Primavera teaches umbrellas of that big type which is known under the name "garden and beach umbrellas." The awning of such an umbrella is spread and tightly stretched by sliding a collar upwardly along the umbrella stick until this collar snaps over a stop resiliently projecting from a recess of the stick. In order to fold the umbrella again, this stop must be pressed into this recess while simultaneously the collar is moved vertically. These operations require large forces due to the large weight and the strong tension of a big awning. In addition, these operations are difficult and tiresome because the stop to be pressed is situated high near the upper end of the stick where it is not easily accessible.

STILL YET ANOTHER EXAMPLE, U.S. Pat. No. 2,661,752 to Kampf et al teaches garden umbrellas and more particularly to garden umbrellas having a hollow mast and being opened and closed by a rope, cable or the like, which with one end is attached to a runner slidably mounted on said mast and with its other end to a manually operated reel. In known garden umbrellas of that type the reel with its shaft is supported by a special frame attached to and extending from the umbrella mast and the reel extends partially through a slot in the mast to receive the rope, cable or the like running within the mast. The frame increased considerably the weight of the umbrella, and resulted in a quite complicated and expensive structure.

YET STILL ANOTHER EXAMPLE, U.S. Pat. No. 2,782,795 to Small teaches collapsible or foldable umbrellas, and is particularly concerned with the operating mechanism of relatively large umbrellas of the beach and garden type.

STILL YET ANOTHER EXAMPLE, U.S. Pat. No. 4,022,233 to Grundman teaches an umbrella structured device which retracts to a compact size including an encircling, retractable and extendable outer drape which can substantially completely protect the umbrella user from rain or other inclement weather. A collapsible attachment provides a means for carrying the umbrella while freeing the user's hands.

YET STILL ANOTHER EXAMPLE, U.S. Pat. No. 4,807,655 to Robertson teaches a garden or sun umbrella provided with spring means for automatically opening the umbrella. In a preferred embodiment the spring is a gas spring mounted inside the central post of the umbrella and is operatively connected to a collar slidably mounted on the post and which in turn is connected via struts to the arm of the umbrella, by means of a flexible cord connected at its opposite ends to the collar and reeved around pulley blocks at opposite ends of the gas spring. After manually initiating the opening of the umbrella by pivoting the arms, in the collapsed position, away from the post, the opening action is completed automatically by the action of the spring. Closing of the umbrella is effected by downward pressure on the arms of the umbrella against the action of the spring.

STILL YET ANOTHER EXAMPLE, U.S. Pat. No. 3,860,022 to Arndt et al. teaches a portable shelter made from a net material that is to be used for protection from bugs and flying insects. The roof of the shelter comprises an extended umbrella-type structure. The central supporting pole can be either affixed to the top of a table, or be located on a special support stand. The shelter sides extend downwardly and outwardly, and the base portions are held in position by stakes inserted into the ground.

YET STILL ANOTHER EXAMPLE, U.S. Pat. No. 4,086,931 to Hall teaches a rectangular umbrella that has its supporting pole positioned at the middle of the back edge so as not to obstruct the space under the umbrella. A vertical sheet of fabric hangs from the back edge and portions of the side edges of the umbrella. This partial enclosure is completed by a removable front panel having a transparent upper portion and attachment means for connection with the umbrella and forward side edges of the vertical back fabric.

The umbrella pole may be mounted on a stadium bench for sports spectators, on a boat seat for fishermen or duck hunters, or thrust into the ground for bird and big game hunters.

STILL YET ANOTHER EXAMPLE, U.S. Pat. No. 4,202,363 to Watts et al. teaches a collapsible shelter of the umbrella-tent type including a foldable frame and a cover of sheet material affixed to the frame. The frame comprises a plurality of support members having mutually respective ends pivotally connected to a central hub. The central hub is mounted on elongate erecting guide means located at the apex of the frame. A second hub is mounted on the guide means below the central hub, and a plurality of rib members are pivotally connected at mutually respective ends to the second hub, with the other ends of the rib members being pivotally connected to corresponding, respective support members, so that when the shelter is in its erected form, the support members extend outwardly and downwardly from the central hub, the second hub is positioned adjacent or proximate to the central hub, the rib members extend substantially radially outwardly from the erecting guide, and the cover is held tautly affixed to the frame. Means are provided for releasably connecting and holding the second hub and the central hub together as a rigid unit to avoid untimely collapse of the shelter by inadvertent, undesired, downward movement of the second hub away from the central hub. The shelter can be collapsed, when desired, by disengaging the second hub from the central hub and moving the second hub downwardly away from the first hub. When the shelter is collapsed, the support members extend downwardly as a bundle from the central hub, the ribs are folded to positions substantially within the bundle of collapsed support members, and the cover is loosely affixed to the frame. In a preferred embodiment, the support members are segmented and can be folded upon themselves to greatly shorten the length of the collapsed bundle thereof.

YET STILL ANOTHER EXAMPLE, U.S. Pat. No. 4,422,468 to Wilson teaches a lawn umbrella expansion device in which an enlarged canopy is provided with a centrally disposed pole cap to engage the tip of an umbrella pole and thereafter be unfurled and stabilized with canopy poles to provide a greatly increased containment area.

STILL YET ANOTHER EXAMPLE, U.S. Pat. No. 1,966,561 to Ratta, Jr. teaches tents which are particularly adapted for use in inclement weather to form a protective covering. In the maintenance of power transmission lines, it is necessary that certain inspection and repairs be made in inclement weather and protective coverings or tents are used at such times for the protection of workmen engaged in these operations and also for the protection of the lines upon which work is being performed, such as open splices, and further for the protection of equipment which is being used in the course of such work.

YET STILL ANOTHER EXAMPLE, U.S. Pat. No. 3,621,857 to May et al. teaches a tent fly in the form of a protective cover of sheet material dimensioned to overlie the roof of the tent that is provided with supporting and tensioning means to mount the fly in taut condition spaced from the roof of the tent, thereby permitting circulation of air beneath the protective cover over the tent roof. The fly includes at least one canopy portion which projects outwardly from an end of the tent. Support means is also provided for the canopy portions, which facilitates its extension and tensioning.

STILL YET ANOTHER EXAMPLE, U.S. Pat. No. 4,285,354 to Beavers teaches a tent consisting of an open-bottomed roofed canopy and foldable frame having corner posts detachably connectable to various socketed supporting structures cooperating therewith to define an aerial tent, a tent for a cherry picker bucket and a ground tent for use in covering the entryway through a manhole to an underground installation. The support subassembly adapting the tent for use as an aerial tent includes vise-like cable clamps detachably connectable to an overhead cable, upwardly divergent sockets for receiving the corner posts of the frame and ties for connecting the canopy to supports positioned above the cable. A second support subassembly provides socketed arms depending from a cherry picker bucket that detachably receive the tent frame corner posts. The latter subassembly includes a high voltage version wherein the arms are detachably secured to the bucket without penetrating same by means of a belted sling.

YET STILL ANOTHER EXAMPLE, E.P.O. Patent No. EP 628264-A1 to Reve teaches an parasol opening and closing mechanism that comprises two brackets with pulleys on a mast and a sleeve which allow the parasol to be deployed by pulling on a cord.

FINALLY, STILL YET ANOTHER EXAMPLE, West Germany Patent No. DE 3521-820-A to Bock teaches large all weather umbrella also useful as washing line that incorporates a block and tackle pulley system for easy opening and closing.

It is apparent that numerous innovations for enclosures have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a combination umbrella and gazebo that avoids the disadvantages of the prior art.

ANOTHER OBJECT of the present invention is to provide a combination umbrella and gazebo that is simple and inexpensive to manufacture.

STILL ANOTHER OBJECT of the present invention is to provide a combination umbrella and gazebo that is simple to use.

BRIEFLY STATED, YET ANOTHER OBJECT of the present invention is to provide a combination umbrella and gazebo that can be used as an umbrella or a gazebo. The combination includes a frame, a canopy, and a side. The canopy is affixed to the frame and has an open position and a closed position. The side is affixed to the canopy and has an extended position in which the combination functions as the gazebo and a retracted position in which the combination functions as the umbrella. And, the side achieves its extended and retracted positions by turning a crank which causes a first cord that is operatively connected to eight second cords which are operatively connected to eight third cords which are operatively connected to the side to displace half as much as each of the eight third cords so as to reduce the amount of turning of the crank required to lower and raise the side.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention being utilized as a gazebo;

FIG. 2 is a diagrammatic perspective view of the present invention being utilized as an umbrella;

FIG. 3 is a diagrammatic elevational view of the frame assembly of the present invention;

FIG. 4 is an enlarged cross sectional view of the area generally enclosed by the dotted ellipse identified by arrow 4 in FIG. 3;

FIG. 5 is an enlarged cross sectional view taken on line 5—5 in FIG. 4;

FIG. 7 is an enlarged elevational view of the area generally enclosed by the dotted ellipse identified by arrow 7 in FIG. 6;

LIST OF REFERENCE NUMERALS UTILIZED IN THE DRAWING

Figures 6, 8, 9:
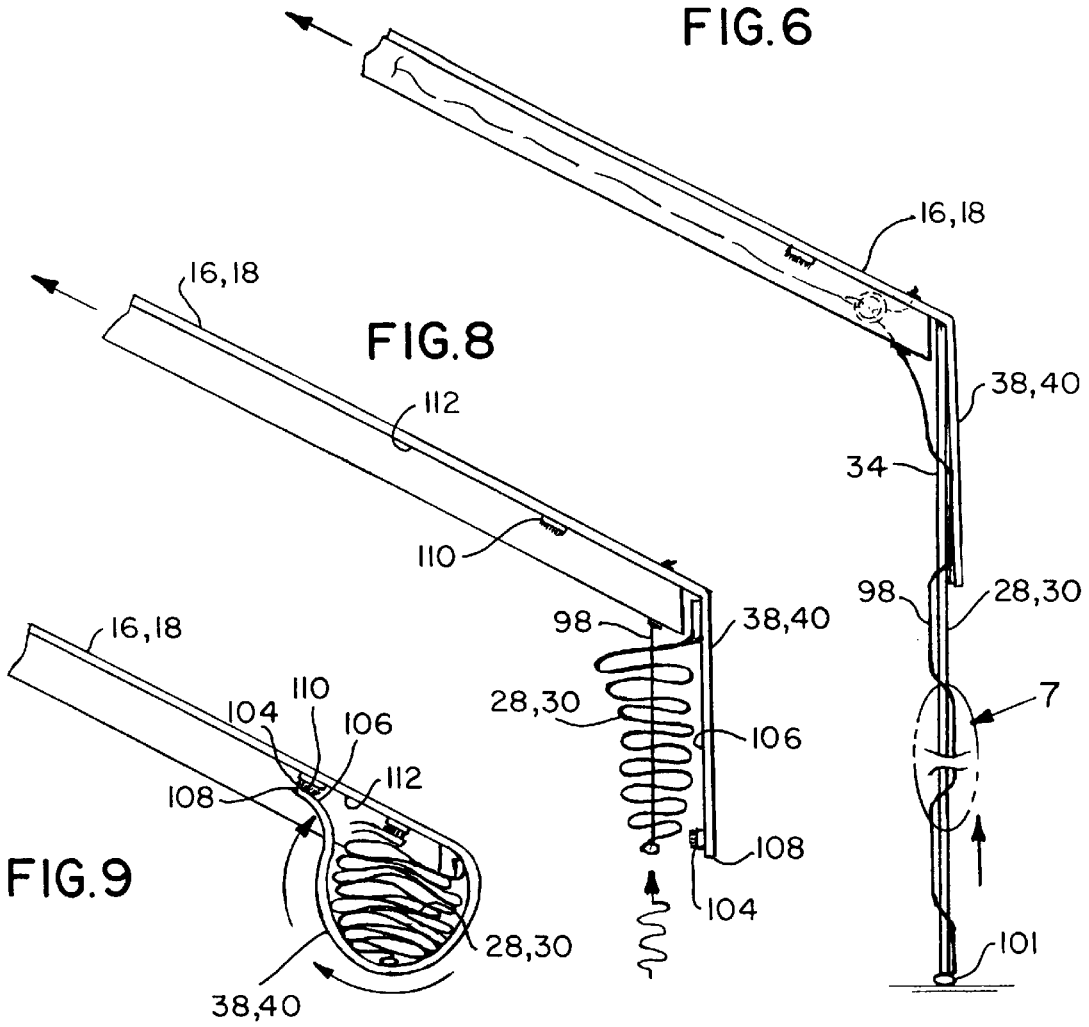
FIG. 6 is a diagrammatic elevational view of the interaction of the frame assembly with the umbrella covering, the skirt, and the netting; with the netting in the extended position.
FIG. 8 is a diagrammatic elevational view of the interaction of the frame assembly with the umbrella covering, the skirt, and the netting; with the netting in the retracted position.
FIG. 9 is a diagrammatic elevational view of the interaction of the frame assembly with the umbrella covering, the skirt, and the netting; with the netting in the stored position.

10 combination umbrella and gazebo of the present invention
12 gazebo
14 umbrella
16 canopy
18 eight canopy panels of canopy 16
20 sides of eight canopy panels 18 of canopy 16
22 canopy seams of sides 20 of eight canopy panels 18 of canopy 16
24 apexes of eight canopy panels 18 of canopy 16
20 side
30 eight side panels of side 20
32 long sides of eight side panels 30 of side 20
34 side of long sides 32 of eight side panels 30 of side 20
35 entrance side panel 35 of eight side panels 30 of side 20
36 short side 36 of each side panel 30 of eight side panels 30 of side 28
37 inner side panel 37 of side 28
38 drape
40 eight drape panels of drape 38
42 short sides of eight drape panels 40 of drape 38
46 long sides of eight drape panels 40 of drape 38
48 frame
50 bottom of frame 48
52 surface
54 peak of frame 48
56 pole of frame 48
58 collar of frame 48
60 eight arms of frame 48
62 proximal ends of eight arms 60 of frame 48
64 free distal ends of eight arms 60 of frame 48
66 eight pivot arms of frame 48
67 upper throughbores in distal ends 64 of eight arms 60 of frame 48
68 proximal ends of eight pivot arms 66 of frame 48
69 bushings in lower throughbores 71 in distal ends 64 of eight arms 60 of frame 48
70 distal ends of eight pivot arms 66 of frame 48
71 lower throughbores in distal ends 64 of eight arms 60 of frame 48
72 first crank of frame 48
73 pulley of frame 48
74 shaft of first crank 72 of frame 48
76 handle of first crank 72 of frame 48
78 first cord of frame 48
80 second crank of frame 48
82 shaft of second crank 80 of frame 48
83 handle of second crank 80 of frame 48
84 second cord of frame 48
86 spring snap hook of frame 48
88 eight third cords of frame 48
90 ends of eight third cords 88 of frame 48
92 diametrically opposed throughbores in peak 54 of frame 48
94 throughbores 94 in diametrically opposed arms 60 of eight arms 60 of frame 48
96 O-rings of frame 48
98 eight fourth cords of frame 48
101 weights of frame 48
102 grommets in side seams 34 of eight side panels 30 of side 28.
104 portion of hook and loop fasteners
106 inner sides 106 of free edges 108 of eight drape panels 38 of drape 40
108 free edges of eight drape panels 38 of drape 40
110 mating portion of hook and loop fasteners
112 inner sides of canopy 16

DETAILED DESCRIPTION OF THE PREFERRED EMBODIMENT

Referring now to the figures in which like numerals indicate like parts, and particularly to FIGS. 1 and 2, the combination umbrella and gazebo of the present invention is shown generally at 10 being utilized as a gazebo 12 and an umbrella 14, respectively.

The configuration of the combination umbrella and gazebo 10 utilized as the gazebo 12 can best be seen in FIG. 1, and as such will be discussed with reference thereto.

The combination umbrella and gazebo 10 utilized as the gazebo 12 includes a canopy 16 that comprises eight canopy panels 18 that are triangular-shaped, foldable, sewn to each other at their sides 20 to form canopy seams 22, and have apexes 24 that are coincident with each other and bases 26 that are continuous with each other.

The combination umbrella and gazebo 10 utilized as the gazebo 12 further includes a side 28 that comprises side panels 30 that are made of Line mesh material.

The long side 32 of two panels 30 of the eight side panels 30 of the side 28 is not connected to the long side 32 of an adjacent side panel 30 of the eight side panels 30 of the side 28 so as to provide an entrance side panel 35 for the gazebo 12.

The side 28 further has an inner side panel 37 of fine mesh material that is connected to the long side 32 of the adjacent side panel 30 of the eight side panels 30 of the side 28, and extends behind and is narrower than the entrance side panel 35 of the eight side panels 30 of the side 28 so as to allow the entrance side panel 35 of the eight side panels 30 of the side 28 to overlap the inner side panel 37 of the side 28 and prevent total opening of the gazebo 12 when it is entered and thereby prevent insects from entering therein.

A short side 36 of each side panel 30 of the eight side panels 30 of the side 28 is sewn to a respective base 26 of the bases 26 of the eight canopy panels 18 of the canopy 16, and are selectively extended therefrom and retracted thereto.

The combination umbrella and gazebo 10 utilized as the gazebo 12 further includes a drape 38 that comprises eight drape panels 40 that are generally rectangular-shaped, slender, elongated, foldable, disposed externally to the eight side panels 30 of the side 28.

A long side 46 of each drape panel 40 of the eight drape panels 40 of the drape 38 is sewn to a respective base 26 of the bases 26 of the eight canopy panels 18 of the canopy 16, and are selectively lowered therefrom and raised thereto.

The configuration of the combination umbrella and gazebo 10 utilized as the umbrella 14 can best be seen in FIG. 2, and as such will be discussed with reference thereto.

The combination umbrella and gazebo 10 utilized as the umbrella 14 includes a frame 48 with a bottom 50 that fits into a standard umbrella base and rests on a surface 52, and a peak 54 which is connected to the apexs 24 of the eight canopy panels 18 of the canopy 16.

As shown, when the combination umbrella and gazebo 10 is utilized as the umbrella 14, the eight side panels 30 of the side 28 are raised behind the bases 26 of the eight canopy panels 18 of the canopy 16, and are maintained thereat by the eight drape panels 40 of the drape 38 which be described in more detail further infra.

The configuration of the frame 48 can best be seen in FIGS. 3–5, and as such will be discussed with reference thereto.

The frame 48 includes a pole 56 that is tubular, elongated, slender, hollow, and vertically-oriented, and has the peak 54 at its highest point and the bottom 50 at its lowest point.

The frame 48 further includes a collar 58 that is longitudinally slidably mounted around the pole 56 of the frame 48.

The frame 48 further includes eight arms 60 that are slender, elongated, hollow, and square-shaped in cross section.

The eight arms 60 of the frame 48 are vertically pivotally mounted to the peak 54 of the pole 48, at their proximal ends 62, and extend radially outwardly therefrom, along the canopy seams 22 of the eight canopy panels 18 of the canopy 16, and have free distal ends 64.

The frame 48 further includes eight pivot arms 66 that are slender, elongated, hollow, and square-shaped in cross section.

The eight pivot arms 66 of the frame 48 are vertically pivotally mounted to the collar 58 of the frame 48, at their proximal ends 68, and extend radially outwardly therefrom, and have distal ends 70.

Each distal end 70 of the distal ends 70 of the eight pivot arms 66 of the frame 48 is pivotally mounted to a respective arm 60 of the eight arms 60 of the frame 48, between the proximal end 62 of the respective arm 60 of the eight arms 60 of the frame 48 and the distal end 64 of the respective arm 60 of the eight arms 60 of the frame 48, so as to allow the eight arms 60 of the frame 48 to extend outwardly when the collar 58 of the frame 48 is slidably raised longitudinally along the pole 56 of the frame 48 and open the canopy 16 and to allow the eight arms 60 of the frame 48 to retract inwardly when the collar 58 of the frame 48 is slidably lowered longitudinally along the pole 56 of the frame 48 and close the canopy 16.

The distal end 64 of each arm 60 of the eight arms 60 of the frame 48 has an upper throughbore 67 that extends transversely therethrough and a lower throughbore 71 that extends transversely therethrough and in alignment with the upper throughbore 66 and has a bushing 69 therein.

The frame 48 further includes a pulley 73 that is vertically rotatably mounted in the pole 56 of the frame 48, between the peak 54 of the pole 56 of the frame 48 and the collar 58 of the frame 48.

The frame 48 further includes a first crank 72 with a shaft 74 that extends transversely into the pole 56 of the frame 48, and a handle 76 that is disposed externally to the pole 56 of the frame 48.

The frame 48 further includes a first cord 78 that is affixed to the shaft 74 of the first crank 72 of the frame 48, passes longitudinally upwardly through the pole 56 of the frame 48, is reeved around the pulley 73 of the frame 48, and extends longitudinally downwardly therefrom to the collar 58 of the frame 48 where it is affixed thereto so as the first crank 72 of the frame 48 is turned in one direction, the first cord 78 of the frame 48 winds around the shaft 74 of the first crank 72 of the frame 48 and causes the collar 58 of the frame 48 to slidably rise longitudinally along the pole 56 of the frame 48, which in turn causes the eight arms 60 of the frame 48 to extend outwardly and open the canopy 16, and as the first crank 72 of the frame 48 is turned in the opposite direction, the first cord 78 of the frame 48 unwinds from the shaft 74 of the first crank 72 of the frame 48 and causes the collar 58 of the frame 48 to slidably lower longitudinally along the pole 56 of the frame 48, which in turn causes the eight arms 60 of the frame 48 to retract inwardly and close the canopy 16.

The frame 48 further includes a second crank 80 with a shaft 82 that extends transversely into the pole 56 of the frame 48, above and parallel to the first crank 72 of the frame 48, and a handle 83 that is disposed externally to the pole 56 of the frame 48.

The frame 48 further includes a second cord 84 that is affixed at one end to the shaft 82 of the second crank 80 of the frame 48, extends longitudinally upwardly through the pole 56 of the frame 48, and terminates in a spring snap hook 86 disposed in the pole 56 of the frame 48.

The frame 48 further includes eight third cords 88 that have ends 90 disposed in the pole 56 of the frame 48 which are releasably secured to the spring snap hook 86 in the pole 56 of the frame 48, and have ends.

The end of each third cord 88 of the eight third cords 88 of the frame 48 extend radially outwardly through diametrically opposed throughbores 92 in the peak 54 of the frame 48, into throughbores 94 in diametrically opposed arms 60 of the eight arms 60 of the frame 48, and terminate therein in O-rings 96 which are disposed in proximity of the distal ends 64 of the eight arms 60 of the frame 48.

The frame 48 further includes eight fourth cords 98.

Each fourth cord 98 of the eight fourth cords 98 of the frame 48 is knotted at one end, passes through the upper throughbore 67 in the distal end 64 of a respective arm 60 of the eight arms 60 of the frame 48, reeves through a respective O-ring 96 of the O-rings 96 of the frame 48, passes downwardly through the bushing 69 in the respective arm 60 of the eight arms 60 of the frame 48, interweaves through a respective side seam 34 of the side seams 34 of the eight side panels 30 of the side 28, and terminates in a weight 101 so as the second crank 80 of the frame 48 is turned in one direction, the second cord 84 of the frame 48 winds around the shaft 83 of the second crank 80 of the frame 48, which in turn causes the spring snap hook 86 of the frame 48 to move downwardly in the pole 56 of the frame 48, which in turn causes the eight third cords 88 of the frame 48 to move downwardly in the pole 56 of the frame 48, which in turn causes the O-rings 96 of the frame 48 to move inwardly in the eight arms 60 of the frame 48, which in turn causes each fourth cord 98 of the eight fourth cords 98 of the frame 48 to move inwardly in the respective arm 60 of the eight arms 60 of the frame 48 at twice the displacement of the second cord 84 of the frame 48 so as to reduce the amount of turning of the second crank 80 of the frame 48 required to raise the side 28, which in turn causes the side 28 to be folded upward to its retracted position and form the umbrella 14, and as the second crank 80 of the frame 48 is turned in the other direction, the second cord 84 of the frame 48 unwinds from the shaft 83 of the second crank 80 of the frame 48 by virtue of the weights 101 of the frame 48, which in turn causes the spring snap hook 86 of the frame 48 to move upwardly in the pole 56 of the frame 48, which in turn causes the eight third cords 88 of the frame 48 to move upwardly in the pole 56 of the frame 48, which in turn causes the O-rings 96 of the frame 48 to move outwardly in the eight arms 60 of the frame 48, which in turn causes each fourth cord 98 of the eight fourth cords 98 of the frame 48 to move outwardly in the respective arm 60 of the eight arms 60 of the frame 48 at twice the displacement of the second cord 84 of the frame 48 so as to reduce the amount of turning of the second crank 80 of the frame 48 required to lower the side 28, which in turn causes the side 28 to be unfold to its extended position and form the gazebo 12.

The interaction of the eight canopy panels 18 of the canopy 16, the eight side panels 30 of the side 28, and the eight drape panels 38 of the drape 40 can best be seen in FIGS. 6–9, and as such will be discussed with reference thereto.

As shown in FIGS. 6 and 7, wherein the side 28 is in its extended position, each fourth cord 98 of the eight fourth cords 98 of the frame 48 is interweaved through grommets 102 in a respective side 34 of the sides 34 of the eight side panels 30 of the side 28.

As shown in FIG. 8, the side 28 is in the process of changing from its extended position to its retracted position.

As shown in FIG. 9, wherein the side 28 is in its retracted position, the eight drape panels 38 of the drape 40 are wrapped inwardly and upwardly under the eight side panels 30 of the side 28, and are maintained thereat by a portion 104 of hook and loop fasteners disposed on an inner side 106 of a free edge 108 of each drape panel 38 of the eight drape panels 38 of the drape 40 mating with a mating portion 110 of the hook and loop fasteners on an inner side 112 of each canopy panel 18 of the canopy 16.

I will be understood that each of the elements described above, or two or more together, may also find a useful application in other types of constructions differing from the types described above.

While the invention has been illustrated and described as embodied in a combination umbrella and gazebo, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination umbrella and gazebo, comprising:

a) a frame;

b) a canopy affixed to said frame and having an open position and a closed position; and c) a side affixed to said canopy and having an extended position and a retracted position, wherein said canopy comprises eight canopy panels that are triangular-shaped, foldable, sewn to each other at their sides to form canopy seams, and have apexes that are coincident with each other and bases that are continuous with each other, wherein said side comprises eight side panels that are generally rectangular-shaped, made of fine mesh material, further comprising a drape comprising eight drape panels being generally rectangular-shaped, slender, elongated, foldable, disposed externally to said eight side panels of said side.

2. A combination umbrella and gazebo, comprising:

a) a frame;

b) a canopy affixed to said frame and having an open position and a closed position; and c) a side affixed to said canopy and having an extended position and a retracted position, wherein said canopy comprises eight canopy panels that are triangular-shaped, foldable, sewn to each other at their sides to form canopy seams, and have apexes that are coincident with each other and bases that are continuous with each other, wherein said side comprises eight side panels that are generally rectangular-shaped, made of fine mesh material, wherein a short side of each side panel of said eight side panels of said side is sewn to a respective base of said bases of said eight canopy panels of said canopy, and are selectively extended therefrom and retracted thereto.

3. The combination as defined in claim 1, wherein a long side of each drape panel of said eight drape panels of said drape is sewn to a respective base of said bases of said eight canopy panels of said canopy, and are selectively lowered therefrom when said combination umbrella and gazebo is utilized as a gazebo and selectively raised thereto when said combination umbrella and gazebo is utilized as an umbrella, with said eight side panels of said side raised behind said bases of said eight canopy panels of said canopy and maintained thereat by said eight drape panels of said drape.

4. The combination as defined in claim 3, wherein said frame has a bottom that fits into a standard umbrella frame and rests on a surface when said combination umbrella and gazebo is in use, and a peak which is connected to said apexs of said eight canopy panels of said canopy.

5. The combination as defined in claim 4, wherein said frame includes a pole that is tubular, elongated, slender, hollow, and vertically-oriented, and has said peak at its highest point and said bottom at its lowest point.

6. The combination as defined in claim 5, wherein said frame further includes a collar that is longitudinally slidably mounted around said pole of said frame.

7. The combination as defined in claim 6, wherein said frame further includes eight arms that are slender, elongated, hollow, square-shaped in cross section, and vertically pivotally mounted to said peak of said pole, at their proximal ends, and extend radially outwardly therefrom, along said canopy seams of said eight canopy panels of said canopy, and have free distal ends.

8. The combination as defined in claim 7, wherein said frame further includes eight pivot arms that are slender, elongated, hollow, square-shaped in cross section, vertically pivotally mounted to said collar of said frame at their proximal ends, extend radially outwardly therefrom, and have distal ends; each distal end of said eight pivot arms of said frame is pivotally mounted to a respective arm of said eight arms of said frame, between said proximal end of said respective arm of said eight arms of said frame and said distal end of said respective arm of said eight arms of said frame, so as to allow said eight arms of said frame to extended outwardly when said collar of said frame is slidably raised longitudinally along said pole of said frame and thereby allowing said canopy to achieve said open position and to allow said eight arms of said frame to retract inwardly when said collar of said frame is slidably lowered longitudinally along said pole of said frame and thereby allowing said canopy to achieve said closed position.

9. The combination as defined in claim 7, wherein said distal end of each arm of said eight arms of said frame has an upper throughbore that extends transversely therethrough and a lower throughbore that extends transversely therethrough and in alignment with said upper throughbore, and has a bushing therein.

10. The combination as defined in claim 9, wherein said frame further includes a pulley that is vertically rotatably mounted in said pole of said frame, between said peak of said pole of said frame and said collar of said frame.

11. The combination as defined in claim 10, wherein said frame further includes a first crank with a shaft that extends transversely into said pole of said frame, and a handle that is disposed external to said pole of said frame.

12. The combination as defined in claim 11, wherein said frame further includes a first cord that is affixed to said shaft of said first crank of said frame, passes longitudinally upwardly through said pole of said frame, is reeved around said pulley of said frame, and extends longitudinally downwardly therefrom to said collar of said frame where it is affixed thereto so as said first crank of said frame is turned in one direction, said first cord of said frame winds around said shaft of said first crank of said frame, which in turn causes said collar of said frame to slidably rise longitudinally along said pole of said frame, which in turn causes said eight arms of said frame to extend outwardly, which in turn causes said canopy to achieve said open position, and as said first crank of said frame is turned in the opposite direction, said first cord of said frame unwinds from said shaft of said first crank of said frame, which in turn causes said collar of said frame to slidably lower longitudinally along said pole of said frame, which in turn causes said eight arms of said frame to retract inwardly, which in turn causes said canopy to achieve said closed position.

13. The combination as defined in claim 12, wherein said frame further includes a second crank with a shaft that extends transversely into said pole of said frame, above and parallel to said first crank of said frame, and a handle that is disposed external to said pole of said frame.

14. The combination as defined in claim 13, wherein said frame further includes a second cord that is affixed at one end to said shaft of said second crank of said frame, extends longitudinally upwardly through said pole of said frame, and terminates in a spring snap hook disposed in said pole of said frame.

15. The combination as defined in claim 14, wherein said frame further includes eight third cords that have ends disposed in said pole of said frame which are releasably secured to said spring snap hook of said frame, and have ends; an end of each third cord of said eight third cords of said frame extend radially outwardly through diametrically opposed throughbores in said peak of said frame, into throughbores in diametrically opposed arms of said eight arms of said frame, and terminate therein in O-rings which are disposed in proximity to said distal ends of said eight arms of said frame.

16. The combination as defined in claim 15, wherein said frame further includes eight fourth cords; each fourth cord of said eight fourth cords of said frame is knotted at one end, passes through said upper throughbore in said distal end of a respective arm of said eight arms of said frame, reeves through a respective O-ring of said O-rings of said frame, passes downwardly through said bushing in said respective arm of said eight arms of said frame, interweaves through a respective side of said sides of said eight side panels of said side, and terminates in a weight so as said second crank of said frame is turned in one direction, said second cord of said frame winds around said shaft of said second crank of said frame, which in turn causes said spring snap hook of said frame to move downwardly in said pole of said frame, which in turn causes said eight third cords of said frame to move downwardly in said pole of said frame, which in turn causes said O-rings of said frame to move inwardly in said eight arms of said frame, which in turn causes each fourth cord of said eight fourth cords of said frame to move inwardly in said respective arm of said eight arms of said frame at twice the displacement of said second cord of said frame so as to reduce the amount of turning of said second crank of said frame required to raise said side, which in turn causes said side to be folded upward and thereby achieve said retracted position and form an umbrella, and as said second crank of said frame is turned in the other direction, said second cord of said frame unwinds from said shaft of said second crank of said frame by virtue of said weights of said frame, which in turn causes said spring snap hook of said frame to move upwardly in said pole of said frame, which in turn causes said eight third cords of said frame to move upwardly in said pole of said frame, which in turn causes said O-rings of said frame to move outwardly in said eight arms of said frame, which in turn causes each fourth cord of said eight fourth cords of said frame to move outwardly in said respective arm of said eight arms of said frame at twice the displacement of said second cord of said frame so as to reduce the amount of turning of said second crank of said frame required to lower said side, which in turn causes said side to be unfold and achieve said extended position and form a gazebo.

17. The combination as defined in claim 16, wherein each fourth cord of said eight fourth cords of said frame is interweaved through grommets in a respective side of said sides of said side.

18. The combination as defined in claim 1, wherein said eight drape panels of said drape are wrapped inwardly and upwardly under said eight side panels of said side and are maintained thereat by a portion of hook and loop fasteners disposed on an inner side of a free edge of each drape panel of said eight drape panels of said drape mating with a mating portion of said hook and loop fasteners disposed on an inner side of each canopy panel of said canopy when said combination umbrella and gazebo is utilized as an umbrella.

19. The combination as defined in claim 1, wherein said long sides of two panels of said eight side panels of said side is not connected to said long side of an adjacent side panel of said eight side panels of said side so as to provide an entrance side panel when said combination umbrella and gazebo is utilized as a gazebo.

20. The combination as defined in claim 19, wherein said sides further have an inner side panel of fine mesh material that is connected to said long side of said adjacent side panel of said eight side panels of said side, and extends behind and is narrower than said entrance side panel of said eight side panels of said side so as to allow said entrance side panel of said eight side panels of said side to overlap said inner side panel of said side and prevent total opening of said gazebo when it is entered and thereby prevent insects from entering therein.

* * * * *